United States Patent [19]

Rate, Jr. et al.

[11] Patent Number: 4,806,113

[45] Date of Patent: Feb. 21, 1989

[54] HIGH VOLTAGE CONNECTOR FOR X-RAY EQUIPMENT

[75] Inventors: Edward T. Rate, Jr., Mequon; John W. Newman, Elm Grove, both of Wis.; Robert W. Meade, Cincinnati, Ohio

[73] Assignee: General Electric Company, Milwaukee, Wis.

[21] Appl. No.: 815,849

[22] Filed: Jan. 3, 1986

[51] Int. Cl.[4] ..... H01R 13/22

[52] U.S. Cl. ..... 439/190; 439/289

[58] Field of Search ..... 339/117 R, 117 P, 64 R, 339/64 M, 186 R; 439/819, 824, 190, 199–201, 246, 252, 289, 205, 206

[56] References Cited

U.S. PATENT DOCUMENTS

| | | | |
|---|---|---|---|
| 1,392,558 | 10/1921 | Darrah et al. | 439/289 |
| 2,046,960 | 7/1936 | Miller | 339/117 R |
| 2,658,182 | 11/1953 | Jackson et al. | 339/64 M |
| 3,742,427 | 6/1973 | Ballard | 339/117 R |
| 3,771,110 | 11/1973 | Reed | 439/824 |
| 4,029,375 | 6/1977 | Gabrielian | 439/824 |
| 4,333,698 | 6/1982 | Herbert | 339/117 R |
| 4,335,928 | 6/1986 | Barrett et al. | 339/117 R |

FOREIGN PATENT DOCUMENTS

| | | | |
|---|---|---|---|
| 0596371 | 4/1934 | Fed. Rep. of Germany | 339/64 R |
| 2117484 | 9/1972 | Fed. Rep. of Germany | 339/117 R |
| 0495055 | 12/1954 | Italy | 339/64 R |
| 0783875 | 12/1980 | U.S.S.R. | 339/64 R |

*Primary Examiner*—Joseph H. McGlynn
*Attorney, Agent, or Firm*—Douglas E. Stoner

[57] ABSTRACT

A high voltage electrical connector set includes a male plug portion and a female receptacle portion. Projecting male contacts are received by female contacts including resilient electrically conductive portions which ensure a secure contact even if the plug and receptacle are somewhat misaligned or incompletely engaged.

10 Claims, 1 Drawing Sheet

HIGH VOLTAGE CONNECTOR FOR X-RAY EQUIPMENT

BACKGROUND OF THE INVENTION

This invention relates to electrical connectors, and more particularly to electrical connectors for high voltage devices, such as X-ray tubes, X-ray transformers and the like.

For decades, high voltage connections for X-ray equipment have remained essentially unchanged. X-ray systems commonly employ voltages in excess of 100 kv. and, thus, use specialized connectors. The type of cable connector generally used in such systems employs a female insulating receptacle on the X-ray tube or high voltage transformer and an insulating male plug which terminates the end of the high voltage cable and is received by the receptacle.

Due to the high voltages and moderate currents used in medical X-ray, relatively small electrical contacts, supported by large insulating bodies, are used. A problem encountered with such an arrangement stems from the fact that the high voltage cables usually have a substantially longer life than X-ray tubes. Therefore, over its useful life, a male plug on a high voltage cable will be mated with receptacles manufactured over a substantial time span, as well as, frequently, by different manufacturers. Small dimensional variations may appear from one unit to the next, sometimes leading to failure to establish reliable electrical contact when the connectors are put together. This can lead to costly errors because the poor contact is sometimes mistaken for an inoperative X-ray tube, the replacement of which is quite costly. This problem, although not occurring frequently, is one of long standing in the X-ray industry.

It is, therefore, an object of this invention to provide an electrical connector for reliably and securably connecting X-ray tubes and transformers to high voltage cables.

SUMMARY OF THE PRESENT INVENTION

Briefly stated, the invention is an electrical connector including a female receptacle portion which is designed to receive a male plug that has at least one electrical male contact projecting therefrom. The receptacle has in one wall thereof at least one recess for mating with the projecting male contact and also substantially encloses within the recess an electrically conductive resilient contact. It is the contact that is relied upon to make the actual connection with the male plug. The resiliency of the contact ensures a secure connection. The relatively low current levels permit the use of small resilient elements.

The connector also includes a provision for fluid passage, such that it may be filled with dielectric insulating fluid and the fluid, to the extent necessary, can be purged from the receptacle as the male plug is inserted therein.

Normally, a locking device is used to secure the male plug in the receptacle and usually provision will be made for several individual connections by using a plug with three of four male contacts and a receptacle with three or four mating recesses.

It has been found that the invention provides a more reliable and secure electrical contact than the systems used or proposed heretofore. Furthermore, as will be described more fully below, a substantially greater tolerance for size variations from one connector to the next is obtained.

The resilient contact may include a spring which can contact the male contact directly, or the spring may have affixed to one end a metal cap which is slideably retained in the recess so that secure electrical contact is provided.

How the foregoing and other more specific objects of the invention are achieved will be evident in the description of the illustrative embodiments of the invention which will be set forth below with reference to the drawings.

DESCRIPTION OF THE PREFERRED EMBODIMENT

Figure 1:
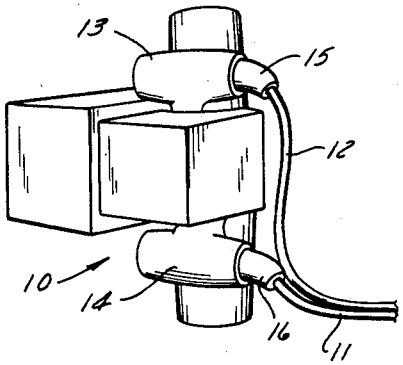
FIG. 1 is a perspective view of a prior art X-ray tube casing to which a high voltage cable is connected.

FIG. 1 shows an X-ray tube casing 10 to which two insulated and metallically sheathed high voltage electric cables 11 and 12 are connected by means of the prior art connectors or the new connector set which is to be described. In FIG. 1, the cable connectors are disposed within parts of the X-ray tube casing 10 which are called horns 13 and 14. Each cable goes through an insulating strain-relief sleeve, such as those marked 15 and 16.

Figure 2:
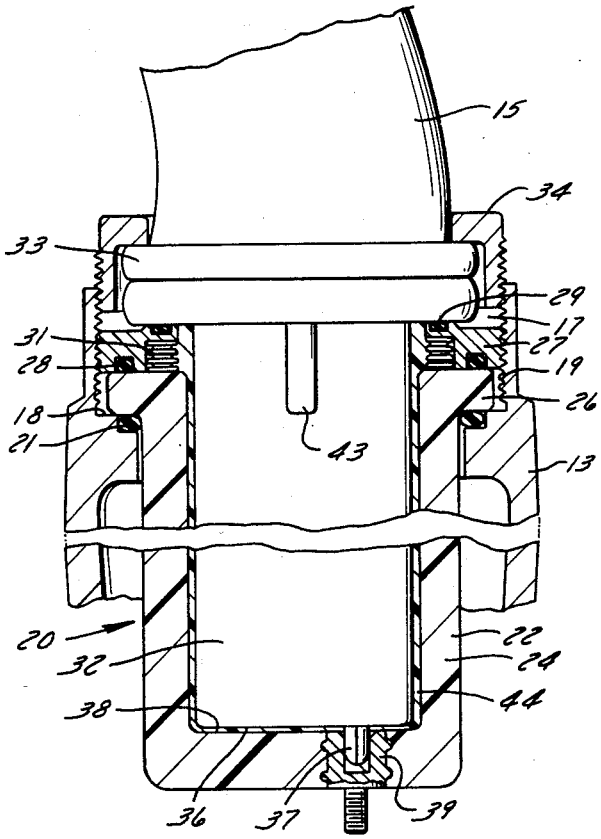
PRIOR ART FIG. 2
FIG. 2 is a partially sectioned view of the prior art connector as it is installed in an apparatus such as an X-ray tube.

Turning next to FIG. 2, a prior art embodiment of the connector is illustrated. In this sectional figure, one of the horns 13 is partially visible. The horn casing 13 is provided with a counterbore 17 which terminates in a shoulder 18 and has an internal threaded portion 19 running from its open end toward shoulder 18. The shoulder has an annular recess for accommodating an elastic O-ring 21 which is used because X-ray tube receptacles (and casings) 10 are generally filled with dielectric fluid. A female receptacle portion 22 extends into casing 13. This receptacle 22 has a hollow cylindrical body 24 made of insulating material which has one end closed and one end open similar to a cup. Near the open end is an integral radially outwardly extending flange 26 whose one face interfaces with and compresses O-ring 21 to effect a seal with the oil-filled casing 13 when the parts of the connector are pressed together.

For installation of the receptacle portion 22 in the casing 13, a threaded retaining ring 27 is engaged in threads 19 to press the flange 26 against the shoulder 18. The O-ring 21 is thus compressed.

Retaining ring 27 has an annular opening in each face to receive O-rings 28 and 29. The O-ring 28 forms a liquid tight seal between the retaining ring 27 and the flange 26.

As is well known in the art, the dielectric fluid contained within the receptacle portion 22 is subjected to substantially varying temperatures. Therefore, expansion and contraction may become a problem. Consequently, the retaining ring 27 may be equipped with an annular bellows assembly 31 to accommodate expansion and contraction of the dielectric medium. The bellows mechanism is fully explained in U.S. Pat. No. 4,335,928, Barrett et al., assigned to the present assignee. The receptacle portion is designed for receiving a male plug portion 32 principally composed of an insulating material of the connector set 20. Between the male plug portion 32 and the strain relief sleeve 15 is a locking flange 33 which, when installed, is pressed against O-ring 29 as well as the upper surface of retaining ring 27 by a threaded locking ring 34 which is engaged in threads 19.

Shown in the lower portion of FIG. 2 is the active electrical contact area. This is shown in more detail in FIG. 3.

Figure 3:
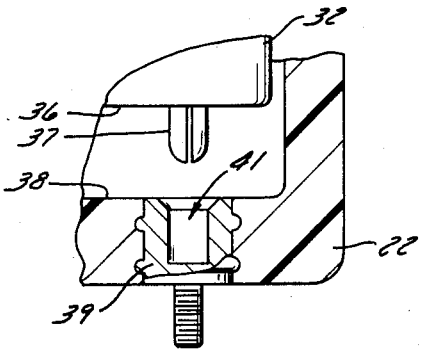
PRIOR ART FIG. 3
FIG. 3 is a detailed sectional view of a portion of the connector shown in FIG. 2.

Referring to FIG. 3, there is shown the prior art electrical contact set. Projecting from the end wall 36 of the plug portion 32 is a male electrical contact 37. As shown in FIG. 3, the contact 37 is split to provide some resiliency. However, it has been found that the contact is so short that the small amount of resiliency provided is often inadequate to ensure a proper electrical contact. It will also be apparent in FIG. 3 that the male electrical contact is not engaging the female contact, as was shown in FIG. 2. The contacts have been separated in FIG. 3 for the sake of clarity.

A problem which sometimes occurs with prior-art connectors is that the slot in the male contact 37 becomes compressed and the circumference of the contact becomes smaller and the connection is even more likely to be faulty. The greater dimensional tolerance of the present invention alleviates this problem.

Still referring to FIG. 3, in the lower wall 38 of the receptacle 22 is a recessed contact 39 defining a recess 41.

When the plug 32 is fully inserted into the receptacle 22 by tightening the locking ring 34 as shown in FIG. 2, the male contact 37 should be fully inserted into the recess 41 as shown in FIG. 2. However, it has been found in practice that the situation depicted in FIG. 4 often occurs. This partial insertion may occur because the receptacle and plug portions are slightly mismatched which may happen due to failure to specify or to meet proper tolerances or failure to thoroughly tighten locking ring 34.

Figure 4:
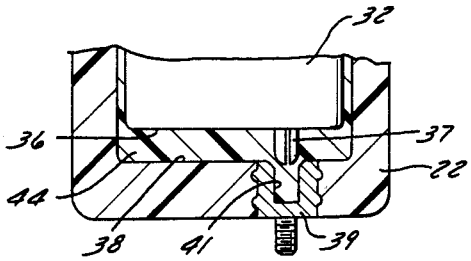
PRIOR ART FIG. 4
FIG. 4 is a detailed view of the active contact portion of the connector shown in FIG. 2 illustrating how faulty electrical contact will sometimes occur.

Another possible cause of the situation depicted in FIG. 4 is that while only one recessed contact 39 and male contact 37 are shown, connector sets 20 typically have three or four mating male contacts 37 and recessed contacts 39. If, for example, one of the contacts 37 is slightly bent, there may be sufficient misalignment with respect to recesses 41 that at least one of the contacts bears against the recessed contact 39 and the contacts will not be fully inserted. Normally, adequate electrical contact will be established for contacts 37 that are bearing against contacts 39, but in the situation depicted in FIG. 4, with multiple contacts, some contacts 37 may be held completely separate from contacts 39 and thus an open circuit will result. In the situation just described, the technician making the connection will feel resistance as he tightens the locking ring 34 due to the misalignment. He may not be able to tell whether there has been full insertion or whether a misalignment situation exists.

It should be noted with respect to embodiments of the connector set 20 including more than one male contact and mating recessed contact, that a key 43 is normally molded as part of the plug 32 and received in a mating key groove (not shown) in the receptacle. The function of the key and groove is, of course, to ensure alignment of the male contacts 37 and the recesses 41 by preventing relative rotation between the plug 32 and receptacle 22.

When connector set 20 is being assembled, the receptacle 22 is normally installed in a housing. Thus, the retaining ring 27 is tightened in place. The housing 10 is oriented such that the opening of the receptacle 22 is up and a small amount of dielectric insulating oil 44 is poured into the receptacle 22. As the plug 32 is received in the receptacle, the oil will rise to fill the gap which is purposely provided between the receptacle 22 and the plug 32. If a proper amount of oil has been used, a small amount of the oil will leak out between retaining ring 27 and flange 33 as locking ring 34 is tightened. The leakage will stop when the flange 33 is forced tightly against the O-ring 29. At that point, the area between the receptacle 22 and the plug 32 is totally filled with dielectric insulating oil. The oil is necessary to provide higher dielectric strength than would be possible if air were left between the receptacle 22 and the plug 32. This is necessary because of the high voltages involved. The function of the oil and conditions surrounding its use are more fully explained in the aforementioned U.S. Pat. No. 4,335,928.

It is important that any replacement contact set include fluid passage means to permit the fluid oil to flow from the recess 41 into the receptacle 22 and up toward the opening of the receptacle.

Figure 5:
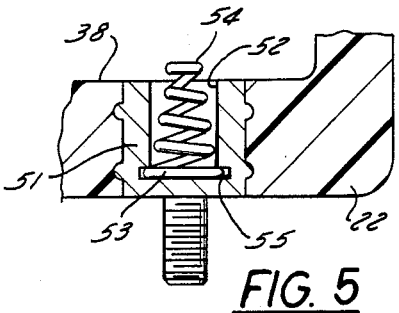
FIG. 5 is a detailed sectional view of the improved recess of the present invention.

Referring now to FIG. 5, there is shown an improved recessed contact 51 wherein the recess 52 substantially encloses an electrically conductive resilient contact which in the preferred embodiment is a metal spring 53. At the outer end of the resiient contact is an active surface for establishing an electrical connection with the male plug 37. In the preferred embodiment, the active surface is the very outer end 54 of the spring 53.

A retaining means, such as a retaining groove 55, is provided at the lower end of the recess 52. The groove receives part of the spring 53 and thus holds it firmly in place. It will be appreciated that the contact 51 can be easily installed in a receptacle 22.

The advantages of the embodment shown in FIG. 5 are several. It will be seen that the spring, although substantially enclosed, can be made to extend beyond the opening of the recess 52 and thus, project beyond the wall 38 of the receptacle 22. Therefore, even in the situation depicted in FIG. 4, secure electrical contact would be made. Furthermore, the spring leaves the recess substantially open so that a wide fluid passage in the recess if provided for the dielectric insulating oil. Finally, a substantial amount of dimensional tolerance is provided not only in the direction in and out of the recess but also transversely to the recess. The electrical contact 37 can be substantially misaligned with the center of the recess 52, but it will still make a secure electrical contact with the active surface 54 of the contact spring 53. Of course, if proper alignment, as shown in FIG. 2, is achieved, the spring simply compresses. While the voltages used in medical X-ray are substantial, a reasonably sized spring can be used because anode current in an X-ray tube rarely exceeds one amp. Even the higher current filament of the X-ray tube typically draws only 6 or 7 amps. Thus, massive electrical contacts are not required.

Figure 6:
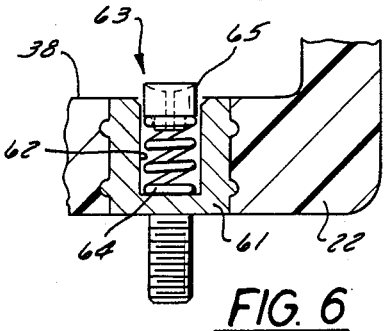
FIG. 6 is a detailed sectional view of an alternative recess and resilient contact arrangement of the present invention.

Referring next to FIG. 6, an alternate embodiment is shown. In the embodiment shown in FIG. 6, the recessed contact 61 defines a recess 62 which substantially encloses the resilient electrical contact 63. The contact 63 includes an electrically conductive metal spring 64 and a metal cap 65 at the end of the spring nearest the opening. The active surface is the outer surface of the metal cap 65. The cap is slideably retained within the recess 62 and thus as will be evident, will provide a reliable electrical contact in the situation depicted in FIG. 4, but will also permit insertion of the male contact 37 into the recess 62 by simple compression of the spring. A fluid passage may be provided in the embodiment shown in FIG. 6 by simply providing a loose fit between the cap 65 and the walls of the recess 62.

Figure 7:
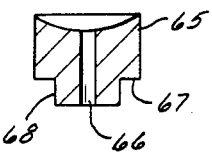
FIG. 7 is a detailed sectional view of the end cap used in the embodiment shown in FIG. 6.

Alternatively, referring to the sectional view of the cap 65 in FIG. 7, a fluid flow channel, such as a grooved periphery or a hole 66 through the cap may be provided. In addition, as is shown in FIG. 7, it has been found that the cap 65 may have an active surface is slightly dish shaped to mate with the rounded end of the normal male contact 37. It has been found easiest to use the embodiment shown in FIGS. 6 and 7 if a shoulder 67 is providd on end cap 65 and the shoulder is sized such that the annular wall 68 created provides a force fit with a turn of the spring 64. Then, the cap 65 and the spring 64, once assembled, can be treated as a single unit.

The embodiment shown in FIGS. 6 and 7, when in a receptacle 22, provides the advantages specified above with respect to the embodiment shown in FIG. 5. One difference, however, is that the embodiment shown in FIG. 5 can be factory assembled, whereas the resilient contact of the embodiment shown in FIGS. 6 and 7 is normally installed at the time the connector set 20 is connected in the field. There is the additionl requirement that the recess 62 be in the upright position when installing the resilient contact, but that is not normally a problem because the receptacle 22 must be in the upright position in order to receive the dielectric insulating oil which is poured in prior to insertion of the plug 32. Naturally, once the locking ring 34 is tightened, the contact 37 holds the resilient contact of the FIGS. 6 and 7 embodiment in place, and the assemebly can be oriented in any direction.

While the invention has been shown in the Figures in an embodiment using only a single recessd contact 51 or 61 in the receptacle 22, it is to be understood that the normal application of the invention will be in receptacles including 3 or 4 recessed contacts 51 or 61. Normally, all of the recessed contacts would be of the same embodment in any single receptacle 22. Although the versatility of the contact is such that the embodiments of FIGS. 5, 6, and 7 could be mixed in a single receptacle and still function properly.

While this invention has been described with reference to particular embodiments and examples, other modifications and variations will occur to those skilled in the art in view of the above teachings. Accordingly, it should be understood that within the scope of the appended claims the invention may be practiced otherwise than is specifically described.

The invention claimed is:

1. An electrical connector comprising:

a female receptacle portion made of an insulating material for receiving a male portion and having in one interior wall thereof at least one recess for mating with a projecting male contact, said female portion including an electrically conductive resilient spring contact connected within said recess and having at its outer end an active surface for establishing an electrical connection with a male contact when a male plug portion is inserted into said female receptacle portion, wherein said active surface projects beyond said one wall unless displaced by a male contact bearing against said active surface; and fluid passage means for permitting fluid flow between said recess and the remainder of said female receptacle portion.

2. The electrcal connector of claim 1 wherein said recess includes retaining means for holding said spring contact therein.

3. The electrical connector of claim 2 wherein said retaining means comprises a groove in said recess into which at least part of said spring contact fits.

4. The electrical connector of claim 1 wherein said active surface is comprised of a metal cap electrically connected to said spring contact and adapted to be slidably retained in said recess when displaced by a male contact bearing against said metal cap.

5. The electrical connector of claim 4 wherein said fluid passage means is comprised of a fluid passage channel passing through said cap.

6. An electrical connector set comprising:

a male plug portion made of an insulating material and having projecting from one end at least one electrical male contact;

a female receptacle portion made of an insulating material for receiving said male portion and having in one interior wall thereof at least one recess for mating with said projecting male contact, said female portion including an electrically conductive resilient spring contact connected within said recess and having at its outer end an active surface for establishing an electrical connection with said male contact when said male plug portion is inserted into said female receptacle portion, wherein said active surface projects beyond said one wall unless displaced by said male contact bearing against said active surface; and fluid passage means for permitting fluid flow between said recess and the remainder of said female receptacle portion.

7. The electrical connector set of claim 6 wherein said recess includes retaining means for holding said spring therein.

8. The electrical connector set of claim 7 wherein said retaining means comprises a groove in said recess into which at least part of said spring contact fits.

9. The electrical connector set of claim 6 wherein said active surface comprises a metal cap electrically connected to said spring contact and adapted to be slidably retained in said recess when displaced by a male contact bearing against said metal cap.

10. The electrical connector set of claim 9 wherein said fluid passage means is comprised of a fluid passage channel passing through said cap.

* * * * *